US005887573A

United States Patent [19]

Janik et al.

[11] Patent Number: 5,887,573

[45] Date of Patent: Mar. 30, 1999

[54] FUEL FILTER WITH COLD START CIRCUIT

[75] Inventors: Leon P. Janik, Suffield; Michael J. Williams, Glastonbury; Richard E. Atwood, East Hampton, all of Conn.

[73] Assignee: Stanadyne Automotive Corp., Windsor, Conn.

[21] Appl. No.: 881,762

[22] Filed: Jun. 25, 1997

[51] Int. Cl.[6] ..... F02M 55/00

[52] U.S. Cl. ..... 123/514

[58] Field of Search ..... 123/510, 514, 123/557

[56] References Cited

U.S. PATENT DOCUMENTS

| | | | |
|---|---|---|---|
| 4,452,213 | 6/1984 | Duprez | 123/514 |
| 4,454,851 | 6/1984 | Bourbonnaud et al. | 123/557 |
| 4,502,450 | 3/1985 | Duprez | 123/514 |
| 4,502,451 | 3/1985 | Duprez | 123/514 |
| 4,625,701 | 12/1986 | Bartlett et al. | 123/514 |
| 4,893,603 | 1/1990 | Siebels | 123/514 |
| 4,984,554 | 1/1991 | Ariga et al. | 123/514 |
| 5,263,456 | 11/1993 | Owen-Evans | 123/514 |
| 5,269,276 | 12/1993 | Brown | 123/514 |

*Primary Examiner*—Thomas N. Moulis
*Attorney, Agent, or Firm*—Alix, Yale & Ristas, LLP

[57] ABSTRACT

A fuel circuit for a fuel system including a fuel tank, a fuel injection system, and a fuel filter assembly. Excess fuel flow is recirculated from the fuel injection pump to the base of the fuel filter. The base includes an internal recirculated fuel passageway which is in fluid communication with the fuel injection pump and the fuel tank, an internal fuel inlet plenum that is in fluid communication with the fuel tank, and an internal fuel outlet passageway which is in fluid communication with the fuel injection system. An opening provides fluid communication between the recirculated fuel passageway and the fuel inlet plenum. A thermal flow control valve is positioned in the recirculated fuel passageway to open the opening when the recirculated fuel temperature is below a predetermined temperature and to close the opening when the recirculated fuel temperature is above the predetermined temperature. For pressurized fuel systems, a constant vent passageway provides fluid communication between the fuel outlet passageway and the recirculated fuel passageway to vent air from the filter assembly.

15 Claims, 5 Drawing Sheets

FUEL FILTER WITH COLD START CIRCUIT

BACKGROUND OF THE INVENTION

This invention relates generally to fuel supply systems which are employed in connection with internal combustion engines. More particularly, the present invention relates to fuel circuits for fuel supply systems which involve fuel injection.

Generally, the fuel injection system contains a fuel injection pump that delivers a higher flow of fuel than is consumed by the engine at the maximum engine power demand. Conventionally, the excess fuel flow is delivered back to the fuel reservoir. Fuel injection pumps are high pressure pumps that generally generate a large amount of heat. Much of this heat is absorbed by the fuel flowing through the pump. The excess fuel returning to the fuel reservoir carries a portion of this heat.

The absence of high standards of quality control in diesel fuel supplies dictates that an effective fuel filter be incorporated into the fuel supply system for a diesel engine. It is not uncommon for diesel fuel to have significant quantities of abrasive particles and water. Diesel fuel also contains a waxy constituent which precipitates as wax crystals when the fuel temperature drops below a characteristic "cloud point". In cold weather conditions, the precipitating wax crystals can rapidly plug a fuel filter and thereby cut off fuel delivery to the internal combustion engine.

A number of conventional fuel filters perform the dual function of removing particulate material from the diesel fuel and separating water from the fuel. Commonly, such fuel filters employ a disposable filter cartridge which is replaced at pre-established intervals of filter usage. Conventional fuel filters may also include a heater element for warming the fuel before it enters the filter cartridge. Such heating elements require positive control to ensure that the proper amount of heat is applied to the fuel. Some conventional fuel supply systems recirculate a portion of the fuel that has been heated by the fuel injection pump. The heated fuel is recirculated to the inlet of the fuel filter to raise the temperature of the fuel that is entering the fuel filter. Such fuel supply systems have typically employed check valves and flow control devices to control the flow of the recirculated fuel and thereby control the temperature of the fuel that enters the fuel filter. These check valves and flow control valves are generally separate components that require mounting in an already crowded engine compartment. In addition, the piping or tube required to connect the check valves and flow control devices takes up additional engine compartment space and requires additional mounting hardware.

SUMMARY OF THE INVENTION

Briefly stated, the invention in a preferred form is a fuel circuit for a fuel system including a fuel tank for storing a quantity of fuel, a fuel injection system for supplying pressurized fuel to the engine, and a fuel filter assembly for removing water and particulate matter from the fuel. The fuel injection system may employ a fuel injection pump, a rail-type configuration or other fuel injection techniques. The fuel filter assembly includes a base providing a compact modular design for controlling the recirculation of fuel from the fuel injection system.

The fuel circuit in accordance with the subject invention includes a fuel passage for recirculating the excess fuel flow produced by the fuel injection system under normal operating conditions. The passageway extends from the recirculation outlet of the fuel injection system to the recirculation inlet port of the base of the fuel filter assembly. The base includes a plurality of internal passageways that replace much of the piping/tubing employed in conventional fuel circuits. For example, in addition to an inlet plenum for receiving fuel from the fuel tank, the base includes a recirculation outlet port for discharging recirculated fuel to the fuel tank, a recirculation inlet passageway and a recirculation outlet passageway providing fluid communication between the recirculation inlet port and the recirculation outlet port and an opening that connects the recirculation inlet passageway with the inlet plenum. Fuel circuit components that are mounted separately in conventional fuel circuits are mounted within the internal passageways of the base. For example, a flow control valve is disposed in the recirculation inlet passageway for selectively opening and closing the opening and thereby controlling the flow of recirculated fuel to the inlet plenum of the fuel filter. Therefore, a base in accordance with the present invention integrates into a single unit multiple components of conventional fuel circuits and thereby facilitates the installation of the fuel circuit in the engine compartment.

The operation of the fuel injection system and fuel lift pump generates heat that is absorbed by the fuel. The flow control valve opens the opening when the temperature of the fuel is below a predetermined value to recirculate the heated fuel to the inlet plenum of the fuel filter. The heated fuel melts any wax crystals that may have formed within the fuel filter and prevents the formation of new wax crystals. When the temperature of the fuel in the fuel filter is above the predetermined value, the flow control valve closes the opening to recirculate the heated fuel to the fuel tank.

An object of the invention is to provide a new and improved apparatus and method for recirculating a portion of the excess fuel flow from the fuel injection pump.

Another object of the invention is to provide an efficient apparatus and method for preventing clogging of the fuel filter by waxy crystals.

A further object of the invention is to provide an efficient fuel circulation system that reduces the number of components that must be mounted within the engine compartment.

Other objects and advantages of the invention will become apparent from the specification and the drawings.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENTS

Figure 1:
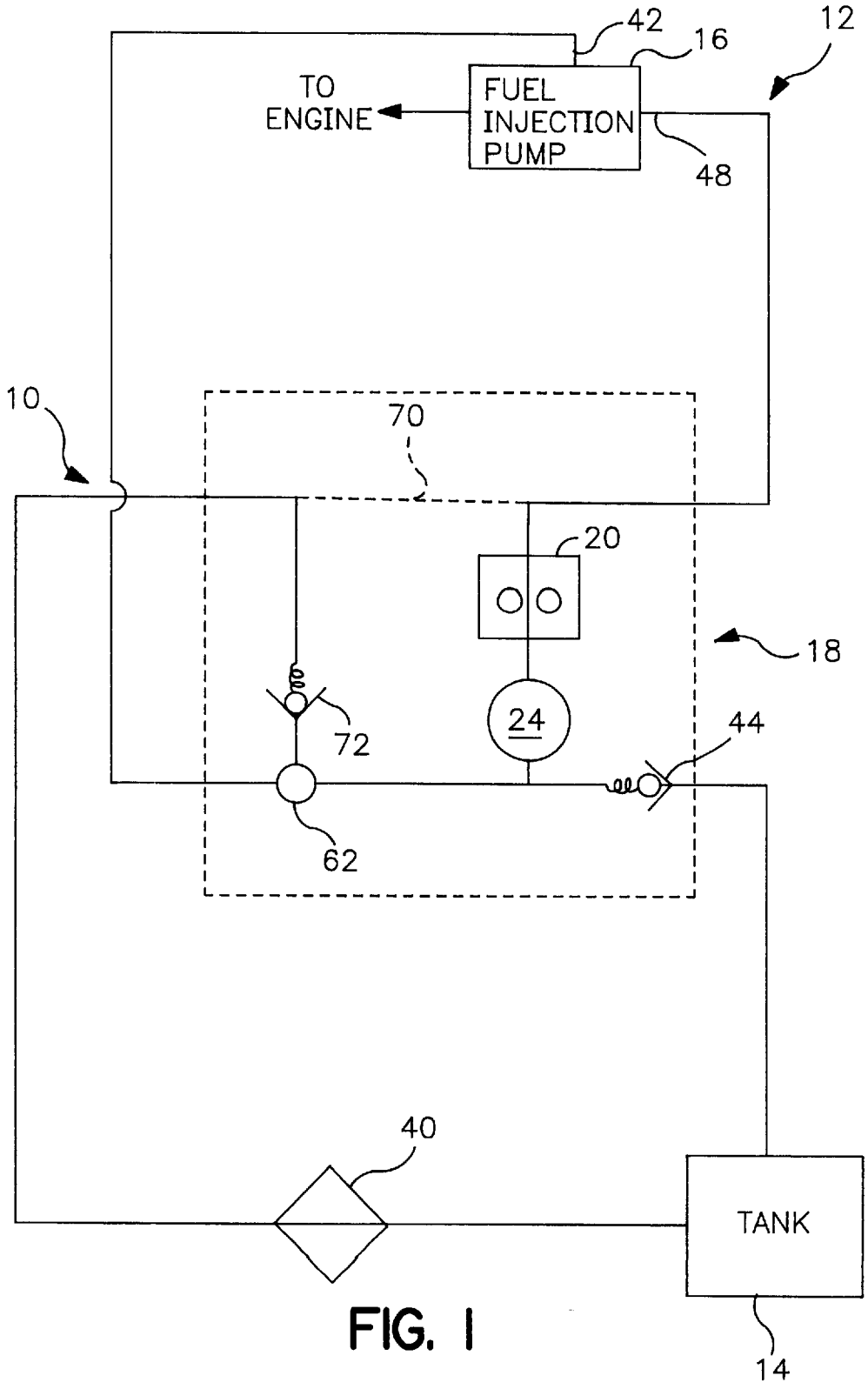
FIG. 1 is a schematic view of a fuel supply system for an internal combustion engine which employs a first embodiment of a fuel circuit in accordance with the present invention.

With reference to the drawings wherein like numerals represent like parts throughout the several figures, a representative fuel system which incorporates a fuel circuit 10 in accordance with the present invention is generally designated by the numeral 12. The fuel system 12 shown in FIG. 1 operates at a positive pressure and comprises a fuel reservoir or tank 14 for storing a quantity of fuel, a fuel injection pump 16 for supplying pressurized fuel to the engine (not shown), a fuel filter assembly 18, 18' for removing water and particulate matter from the fuel, and a fuel lift pump unit 20 for providing sufficient pressure to produce a flow of fuel from the fuel tank 14 to the fuel injection pump 16. The fuel circuits described herein are illustrated in conjunction with a fuel injection pump 16. However, the invention has applicability in connection with numerous types of fuel injection systems, including rail-type systems and accumulator systems.

Figure 2:
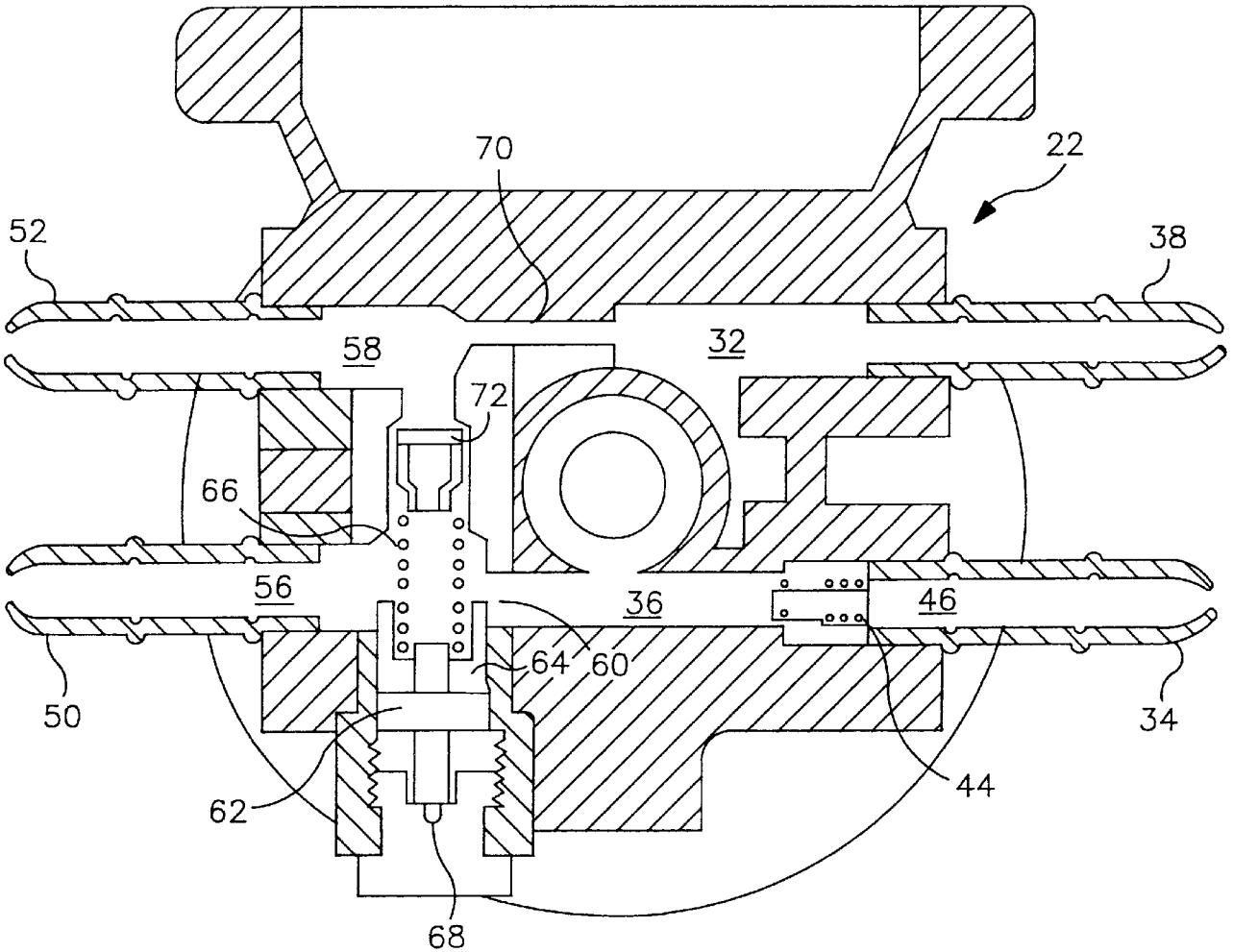
FIG. 2 is a top view, partly broken away and partly in section with portions removed, illustrating the base of the fuel filter assembly of FIG. 1.

With reference to FIGS. 1 and 2, the fuel filter assembly 18 comprises a base 22 and a disposable filter cartridge 24 which is secured to the base 22 by means of a retaining ring or collar (not shown). The filter cartridge 24 houses a filter (not shown) which has a defined useful life. The cartridge is periodically replaced with a compatible replacement cartridge when the filtering qualities have been sufficiently degraded. The cartridge 24 may contain a dual stage or other type filtering system which generally functions to remove particulate matter from the fuel line and optionally to separate water from the fuel.

Figure 5:
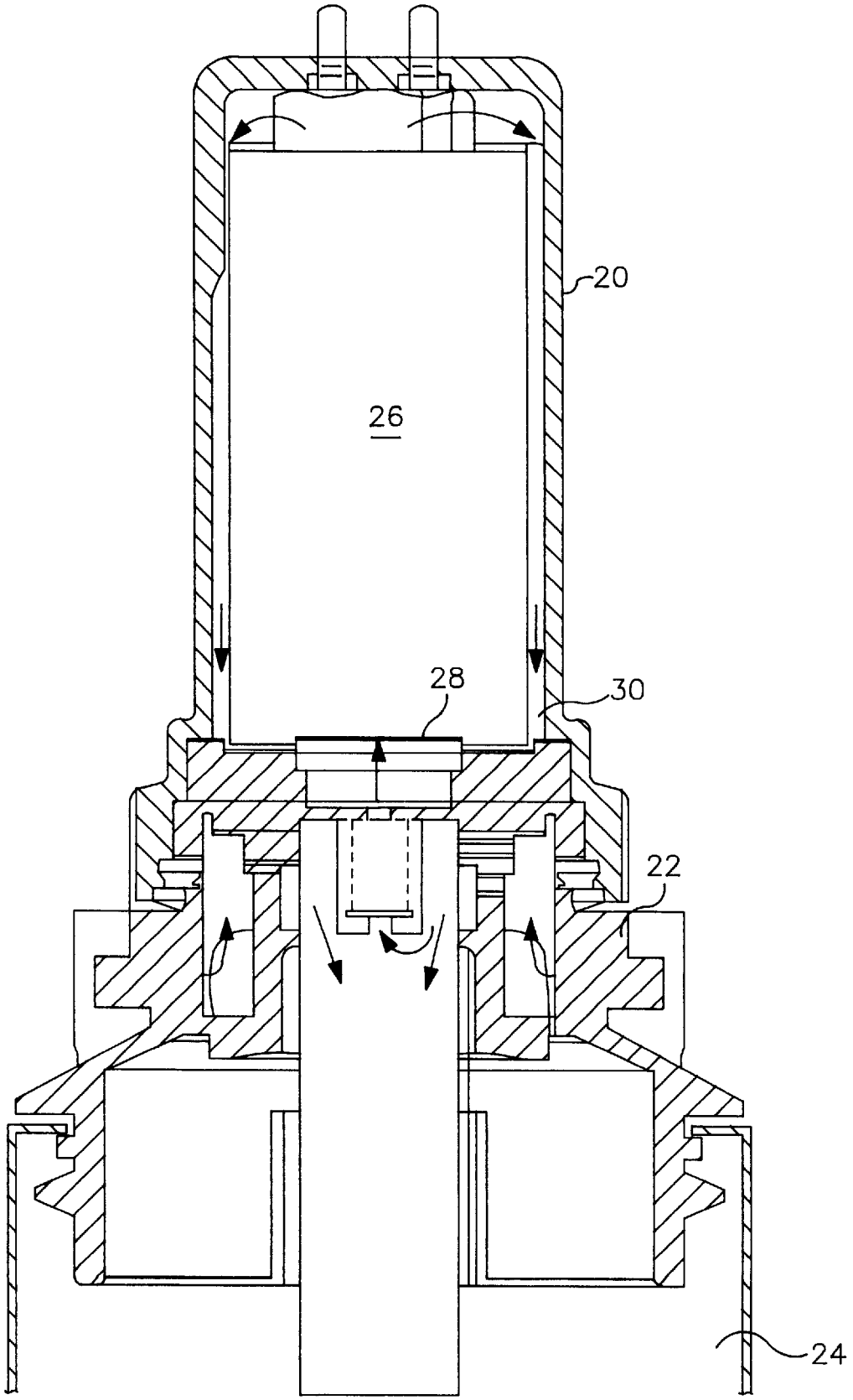
FIG. 5 is an enlarged fragmentary sectional view, partly in schematic, of the fuel filter assembly base and lift pump of FIG. 1.

With reference to FIG. 5, the fuel lift pump unit 20 is mounted to the base 22 opposite the cartridge 24. Such a fuel filter assembly 18 is described in copending U.S. patent application Ser. No. 08/634,812 filed on Apr. 19, 1996, which application is assigned to the assignee of the present invention and the disclosure of which is incorporated herein by reference. The fuel lift pump unit 20 comprises an electric pump 26 which functions to supply a steady supply of fuel to the fuel injection pump 16 from the fuel tank 14, via the fuel filter assembly 18. The fuel lift pump 26 is a positive displacement, in-line roller vane-type or gerotor pump which is generally centrally disposed in a housing. The inlet 28 of the fuel lift pump 26 is in fluid communication with the filter cartridge 24, downstream of the filter element, and the outlet 30 of the fuel lift pump 26 is in fluid communication with the fuel outlet passageway 32 in the base 22 of the filter assembly 18, as shown in FIGS. 1, 2 and 5. The fuel is pulled from the fuel tank 14, through the inlet port 34, the inlet plenum 36, and the filter cartridge 24 to the inlet 28 of the lift pump 26. The pressurized fuel is discharged through outlet 30 of the lift pump 26, the fuel outlet passageway 32 and the fuel outlet port 38 to the fuel injection pump 16.

The flow of fuel required by the engine is proportional to the power demand on the engine. Generally, both the fuel lift pump unit 20 and the fuel injection pump 16 are constant capacity pumps that are sized to provide a flow of fuel that exceeds the engine fuel consumption at the maximum power demand. Consequently, the fuel lift pump unit 20 and the fuel injection pump 16 provide excess fuel flow. The operation of the fuel injection pump 16 and fuel lift pump unit 20 generates heat which is absorbed by the fuel flow. A portion of this heat is carried by the excess fuel flow. Conventionally, such excess fuel flow is delivered back to the fuel tank 14. With reference to the two fuel circuit embodiments 10, 10' (FIGS. 1, 3), this heat may be removed by a heat exchanger 40 to prevent overheating of the fuel in the fuel tank 14.

The waxy constituent of diesel fuel can precipitate as wax crystals when the fuel temperature drops below a characteristic "cloud point". In cold weather conditions, the precipitating wax crystals can rapidly plug a fuel filter and thereby cut off fuel delivery to the internal combustion engine. Some conventional fuel supply systems recirculate a portion of the fuel that has been heated by the fuel injection pump to the inlet of the fuel filter to raise the temperature of the fuel that is entering the fuel filter to melt the wax crystals and/or prevent their formation. Such fuel supply systems employ separate check valves and flow control devices to control the flow of the recirculated fuel and thereby control the temperature of the fuel that enters the fuel filter. These check valves and flow control valves and the piping/tubing that is required to connect them to the fuel supply system can be extremely difficult to mount in an already crowded engine compartment.

Figure 3:
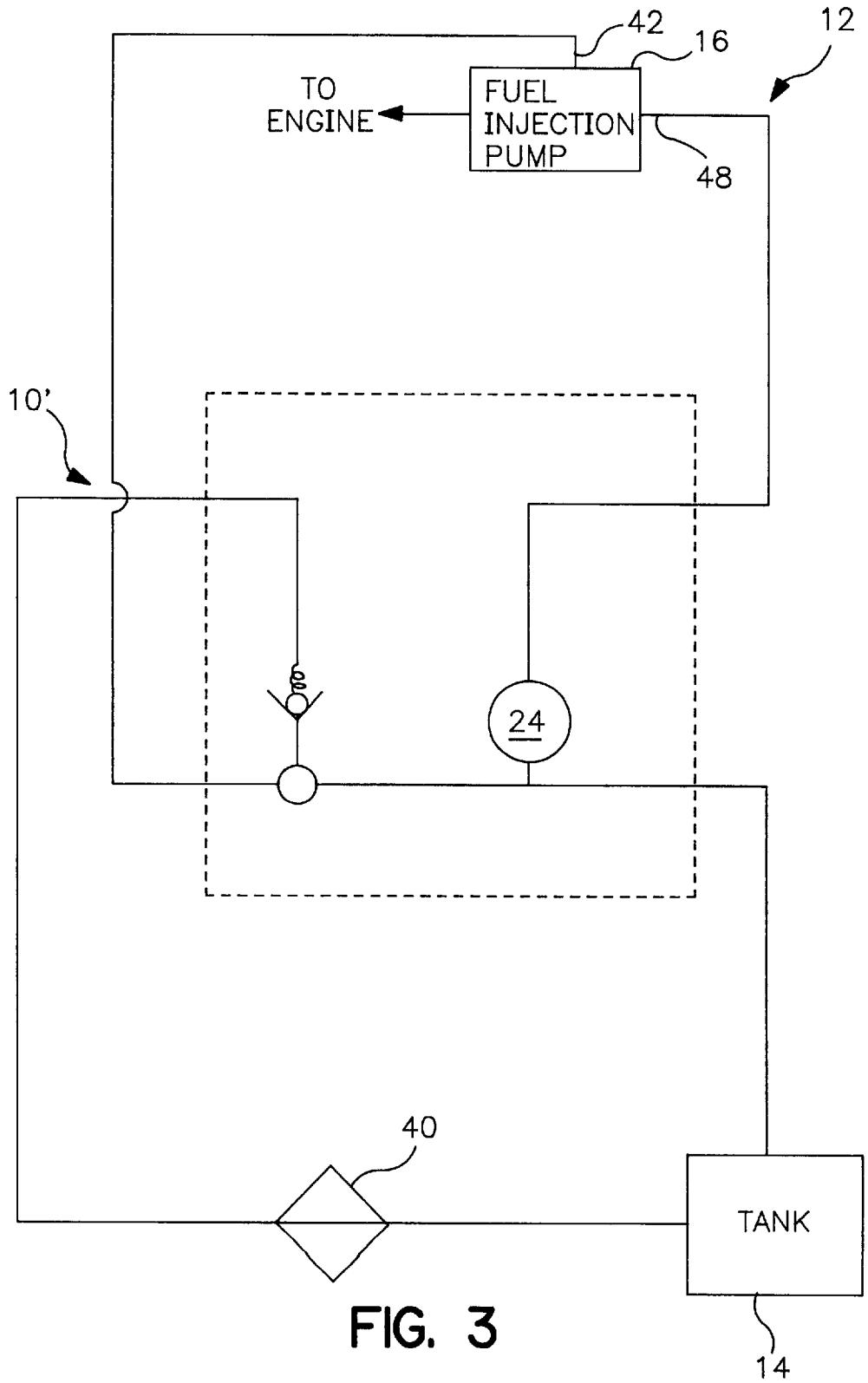
FIG. 3 is a schematic view of a fuel supply system for an internal combustion engine which employs a second embodiment of a fuel circuit in accordance with the invention.

A fuel circuit 10, 10' in accordance with the subject invention includes a fuel passage for recirculating at least a portion of the heated excess fuel flow from the recirculation outlet 42 of the fuel injection pump 16 to the inlet plenum 36 of the fuel filter. Since the fuel tank 14 is at atmospheric pressure and the excess fuel flow is pressurized by the fuel injection pump 16, the excess fuel flow is preferentially utilized as the source of fuel. A flow check valve 44 may be included in the fuel circuit 10, as shown in FIGS. 1 and 2, to provide a limited flow resistance to impede the flow of fuel from the fuel tank 14. This ensures that the excess fuel flow is preferentially utilized as the source of fuel. Alternatively, a flow check valve may not be included, as shown in FIG. 3. If a flow check valve 44 is utilized, it is mounted in the fuel filter base 22 in the fuel inlet passageway 46 intermediate the fuel inlet port 34 and the inlet plenum 36.

Figure 4:
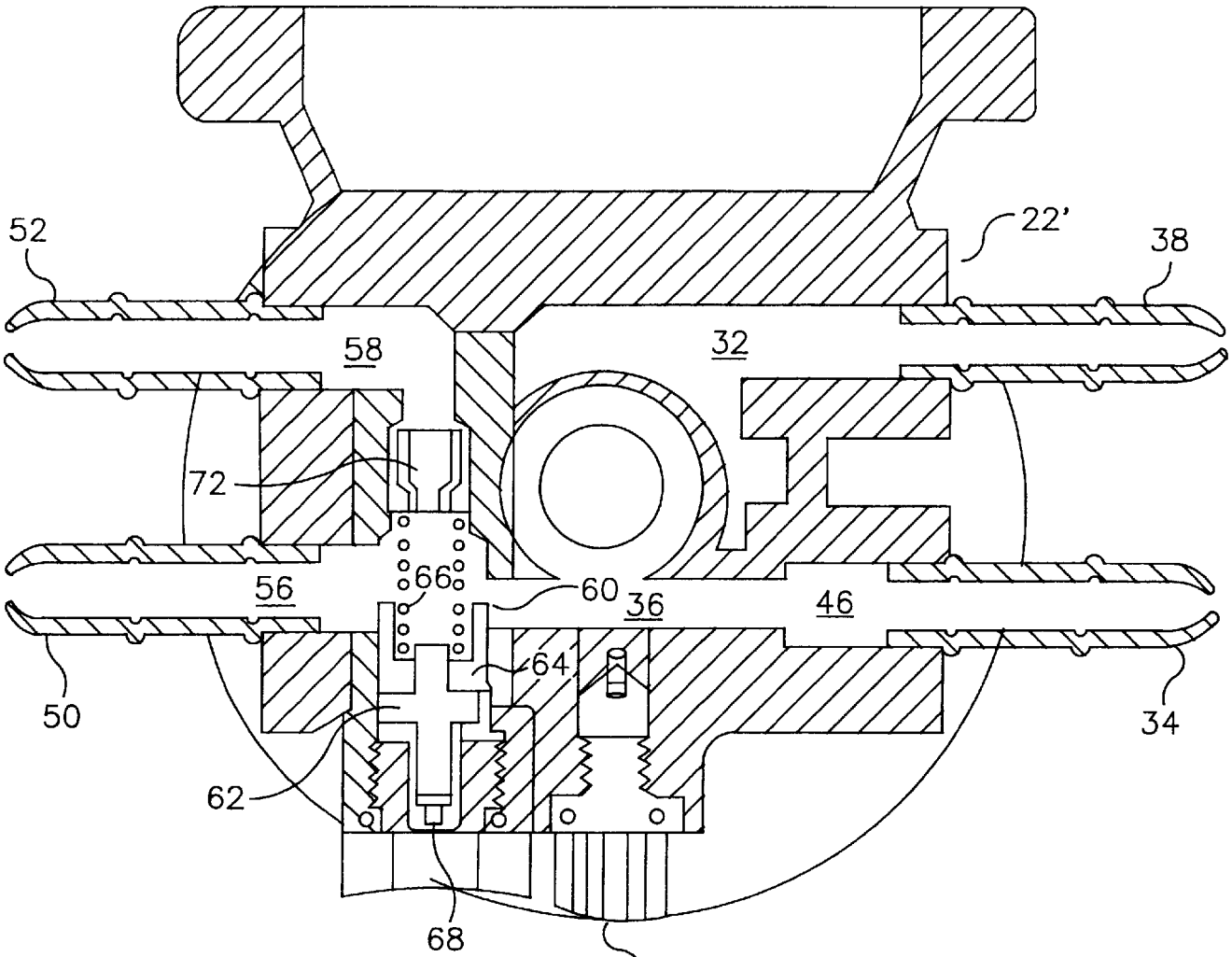
FIG. 4 is a top view, partly broken away and partly in section with portions removed, illustrating the base of the fuel filter assembly of FIG. 3.

The base 22 of the fuel filter includes a fuel inlet port 34 in fluid communication with the fuel tank 14, a fuel outlet port 38 in fluid communication with the inlet 48 of the fuel injection pump 16, a recirculated fuel inlet port 50 in fluid communication with the recirculation outlet 42 of the fuel injection pump 16, and a recirculated fuel outlet port 52 in fluid communication with the fuel tank 14. As described above, the fuel inlet port 34 is in fluid communication with the fuel inlet plenum 36 via the fuel inlet passageway 46. The recirculated fuel inlet port 50 is in fluid communication with the recirculated fuel outlet port 52 via a recirculated fuel inlet passageway 56 and a recirculated fuel outlet passageway 58. An opening 60 connects the recirculated fuel inlet passageway 56 with the fuel inlet plenum 36. The recirculated fuel outlet passageway 58 intersects the recirculated fuel inlet passageway 56 to define a T-shaped intersection, as shown in FIGS. 2 and 4. Preferably, a thermal control valve 62 is disposed opposite the T-shaped intersection to control the flow of the recirculated fuel within the base 22 of the fuel filter by opening or closing the opening 60. Alternatively, the thermal control valve 62 may be disposed intermediate the T-shaped intersection and the inlet plenum.

Preferably, the thermal control valve 62 is a wax motor or bi-metallic flow control of the type utilized as a thermostat in the radiator temperature control system. When the temperature of the fuel flowing through the thermal control valve 62 is at or below 40° F., the valve body 64 of the thermal control valve 62 is biased by a spring 66 away from the opening 60 to the fuel inlet plenum 36, thereby providing fluid communication between the recirculated fuel inlet passageway 56 and the fuel inlet plenum 36. Since the fuel tank 14 is at atmospheric pressure and the fuel lift pump unit 20 is disposed intermediate the fuel filter cartridge 24 and the fuel injection pump 16, the suction of the lift pump 26 causes the recirculated fuel flow to preferentially flow through the filter assembly 18 to the lift pump 26. Excess recirculated fuel that is not required by the lift pump 26 may flow to the fuel tank 14 via the recirculated fuel outlet passageway 58 and the recirculated fuel outlet port 52.

When the temperature of the fuel is above 40° F., the bimetallic shaft 68 of the thermal control valve 62 straightens, compressing the spring 66 and urging the valve body 64 upward. The valve body 64 moves approximately 0.10 inches to close the opening 60 to the fuel inlet plenum 36. Consequently, all of the recirculated fuel flowing from the fuel injection pump 16 is diverted to the fuel tank 14 via the recirculated fuel outlet passageway 58 and the recirculated fuel outlet port 52.

In the pressurized fuel system shown in FIGS. 1 and 2, the base 22 of the fuel filter assembly 18 includes a constant air bleed passageway 70 that provides fluid communication between the recirculated fuel outlet passageway 58 and the fuel outlet passageway 32. Air that accumulates in the fuel filter will be drawn through the air bleed passageway 70, entrained in the flow of recirculated fuel, and delivered to the fuel tank 14. A flow check valve 72 is disposed within the recirculated fuel outlet passage 58 to prevent the air entrained in the recirculated fuel from re-entering the fuel filter. Usually the flow check valve 72 is unseated to allow the flow recirculated fuel through the base 22 to the fuel tank 14.

The fuel system 12' shown in FIG. 3 operates at a negative pressure and is similar to fuel system 12 shown in FIG. 1 except that it does not include a fuel lift pump. In addition, the fuel filter assembly 18' employed in the system has in internal vent and a hand primer. Fuel filter assemblies having an internal vent are described in U.S. Pat. Nos. 5,413,711 and 5,525,225 and a fuel filter assembly having a hand primer is described in U.S. Pat. No. 5,578,221. These patents are assigned to the assignee of the present invention and the disclosure of which is incorporated herein by reference. Since the internal vent prevents air from accumulating within the fuel filter, the constant air bleed passageway is not required and has been eliminated from the base 22'. In addition, the check valve 72 in the recirculated fuel outlet passageway may be eliminated. The base 22' includes a manual vent 74 that is opened during operation of the hand primer.

The described fuel circuits 10, 10' function in an efficient manner to recirculate a portion of the fuel that has been heated by the fuel injection pump into the inlet plenum 36 of the fuel filter. Such heated fuel melts wax crystals that have formed within the fuel filter and prevents the formation of new wax crystals. Mounting the thermal control valve 62 and the two flow check valves 44, 72 within internal passageways 46, 58 of the base 22, 22' of the fuel filter minimizes the number of separate components which must be mounted in the engine compartment. In addition, the use of such internal passageways 32, 46, 56, 58 minimizes the amount of pipe or tube that must be used to connect elements of the fuel circuit 10, 10'. This further reduces the number of separate components that must be mounted in the engine compartment and also reduces the cost of the fuel circuit 10, 10'. The excess fuel is recirculated in an efficient manner that exploits the output pressure from the injection system to transfer the recirculated excess fuel back to the fuel filter.

While preferred embodiments have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A fuel circulation circuit for a fuel system for supplying fuel to an engine, the fuel system having a fuel tank, the fuel circulation circuit comprising:

a fuel injection system comprising an inlet, first outlet means for supplying a flow of combustion fuel to the engine and recirculation outlet means for recirculating a flow of excess fuel;

filter means for filtering a flow of fuel, said filter means comprising a filter cartridge and a base having inlet plenum means in fluid communication with said fuel tank for receiving the fuel, a fuel outlet passageway in fluid communication with said inlet of said fuel injection system, a recirculation inlet port in fluid communication with said recirculation outlet means, a recirculation inlet passageway in fluid communication with said recirculation inlet port and having a portion defining an inlet opening for providing fluid communication with said inlet plenum means, a recirculation outlet port in fluid communication with said tank, a recirculation outlet passageway in fluid communication with said recirculation outlet port and said recirculation inlet passageway;

flow control means disposed in said recirculation inlet passageway for selectively opening and closing said opening; and a lift pump having an inlet in fluid communication with said inlet plenum via said filter cartridge and an outlet in fluid communication with said fuel outlet passageway.

2. The fuel circulation circuit of claim 1 wherein said base further comprises a fuel inlet port in fluid communication with said fuel tank and a fuel inlet passageway disposed intermediate said inlet plenum and said fuel inlet port.

3. The fuel circulation circuit of claim 2 further comprising flow restriction means disposed in said fuel inlet passageway for resisting the flow of fuel through said fuel inlet passageway.

4. The fuel circulation circuit of claim 3 wherein said flow restriction means comprises a check valve.

5. The fuel circulation circuit of claim 4 wherein said check valve has a valve seat and a valve body, wherein said valve body engages said valve seat to prevent flow from said inlet plenum to said fuel inlet port.

6. The fuel circulation circuit of claim 1 wherein said base further comprises vent passageway means for providing fluid communication between said fuel outlet passageway and said recirculation outlet passageway.

7. A method for heating the fuel in a fuel filter disposed in a fuel supply system for an engine, the fuel supply system further including a fuel injection system, and a fuel tank, the fuel filter having a base including an inlet plenum in fluid communication with the fuel tank, a recirculation passageway in fluid communication with the fuel tank and the fuel injection system, an opening for providing fluid communication between the inlet plenum and the recirculation passageway, and a flow control valve disposed in the recirculation passageway for selectively opening and closing the opening, the method comprising the steps of:

pumping fuel from the fuel tank to the engine via the fuel injection system thereby producing a flow of heated fuel;

diverting an excess portion of the flow of heated fuel from the fuel injection system to the recirculation passageway;

opening the opening when the temperature of the excess portion of the flow of fuel is below a predetermined temperature; and closing the opening when the temperature of the excess portion of the flow of fuel is above a predetermined temperature.

8. The method of claim 7 wherein the base further has a fuel inlet passageway intermediate the inlet plenum and the fuel tank and the method further comprises the step of restricting the flow of fuel from the fuel tank with a flow restrictor disposed within the fuel inlet passageway whereby the excess portion of the flow of heated fuel preferentially flows into the inlet plenum.

9. The method of claim 7 wherein the base further has an fuel outlet passageway in fluid communication with the fuel injection system and a vent passageway providing fluid communication between the fuel outlet passageway and the recirculation passageway and the method further comprises the step of venting air from the fuel outlet passageway to the fuel tank via the recirculation passageway.

10. A fuel circulation circuit for a fuel system for supplying fuel to an engine, the fuel system having a fuel tank, the fuel circulation circuit comprising;

a fuel injection system comprising an inlet and a recirculation outlet;

a filter comprising a filter cartridge and a base having an inlet plenum in fluid communication with said fuel tank for receiving the fuel, a fuel outlet passageway in fluid communication with said inlet of said fuel injection system, a recirculation inlet port in fluid communication with said recirculation outlet of said fuel injection system, a recirculation inlet passageway in fluid communication with said recirculation inlet port and having a portion defining an inlet opening for providing fluid communication with said inlet plenum, a recirculation outlet port in fluid communication with said recirculation outlet port and said recirculation inlet passageway;

a flow control disposed in said recirculation inlet passageway for selectively opening and closing said opening; and a lift pump having an inlet in fluid communication with said inlet plenum via said filter cartridge and an outlet in fluid communication with said fuel outlet passageway.

11. The fuel circulation circuit of claim 10 wherein said base further comprises a fuel inlet port in fluid communication with said fuel tank, a fuel inlet passageway disposed intermediate said inlet plenum and said fuel inlet port, and a flow restrictor disposed in said fuel inlet passageway for resisting flow of the fuel through said fuel inlet passageway.

12. The fuel circulation circuit of claim 10 wherein said flow control comprises a wax motor.

13. The fuel circulation circuit of claim 10 wherein said base further comprises a vent passageway providing fluid communication between said fuel outlet passageway and said recirculation outlet passageway.

14. A fuel circulation circuit for a fuel system for supplying fuel to an engine, the fuel system having a fuel tank, the fuel circulation circuit comprising:

a fuel injection system comprising an inlet, first outlet means for supplying a flow of combustion fuel to the engine and recirculation outlet means for recirculating a flow of excess fuel;

filter means for filtering a flow of fuel, said filter means comprising a base having inlet plenum means in fluid communication with said fuel tank for receiving the fuel, a recirculation inlet port in fluid communication with said recirculation outlet means, a recirculation inlet passageway in fluid communication with said recirculation inlet port and having a portion defining an inlet opening for providing fluid communication with said inlet plenum means, a recirculation outlet port in fluid communication with said tank, a recirculation outlet passageway in fluid communication with said recirculation outlet port and said recirculation inlet passageway;

flow control means disposed in said recirculation inlet passageway for selectively opening and closing said opening; and check valve means disposed in said recirculation outlet passageway for preventing flow from said recirculation outlet passageway to said recirculation inlet passageway.

15. A fuel circulation circuit for a fuel system for supplying fuel to an engine, the fuel system having a fuel tank, the fuel circulation circuit comprising:

a fuel injection system comprising an inlet, first outlet means for supplying a flow of combustion fuel to the engine and recirculation outlet means for recirculating a flow of excess fuel;

filter means for filtering a flow of fuel, said filter means comprising a base having inlet plenum means in fluid communication with said fuel tank for receiving the fuel, a recirculation inlet port in fluid communication with said recirculation outlet means, a recirculation inlet passageway in fluid communication with said recirculation inlet port and having a portion defining an inlet opening for providing fluid communication with said inlet plenum means, a recirculation outlet port in fluid communication with said tank, a recirculation outlet passageway in fluid communication with said recirculation outlet port and said recirculation inlet passageway; and flow control means disposed in said recirculation inlet passageway for selectively opening and closing said opening, said flow control means comprising a wax motor.

* * * * *